US007646149B2

(12) United States Patent
Naaman et al.

(10) Patent No.: US 7,646,149 B2
(45) Date of Patent: Jan. 12, 2010

(54) ELECTRONIC SWITCHING DEVICE

(75) Inventors: Ron Naaman, Rehovot (IL); Erez Halahmi, Bazra (IL)

(73) Assignee: Yeda Research and Development Company, Ltd,, Rehovot (IL)

( * ) Notice: Subject to any disclaimer, the term of this patent is extended or adjusted under 35 U.S.C. 154(b) by 705 days.

(21) Appl. No.: 10/895,980

(22) Filed: Jul. 22, 2004

(65) Prior Publication Data

US 2005/0018467 A1 Jan. 27, 2005

Related U.S. Application Data

(60) Provisional application No. 60/488,797, filed on Jul. 22, 2003, provisional application No. 60/517,387, filed on Nov. 6, 2003.

(51) Int. Cl.
*H01J 40/06* (2006.01)

(52) U.S. Cl. ..... 313/542

(58) Field of Classification Search ..... 313/542, 313/576; 315/150

See application file for complete search history.

(56) References Cited

U.S. PATENT DOCUMENTS

| | | | | |
|---|---|---|---|---|
| 3,739,227 | A * | 6/1973 | Nastjukha et al. | 313/161 |
| 4,577,133 | A | 3/1986 | Wilson | |
| 4,683,399 | A | 7/1987 | Soclof | |
| 4,721,885 | A * | 1/1988 | Brodie | 313/576 |
| 4,771,168 | A * | 9/1988 | Gundersen et al. | 313/538 |
| 4,857,799 | A | 8/1989 | Spindt et al. | |
| 4,956,574 | A | 9/1990 | Kane | |
| 4,990,766 | A | 2/1991 | Simms et al. | |
| 5,057,740 | A * | 10/1991 | Kirkman-Amemiya | 313/542 |
| 5,066,883 | A | 11/1991 | Yoshioka et al. | |
| 5,077,597 | A | 12/1991 | Mishra | |
| 5,192,240 | A | 3/1993 | Komatsu | |
| 5,214,346 | A | 5/1993 | Komatsu | |
| 5,233,263 | A | 8/1993 | Cronin et al. | |
| 5,308,439 | A | 5/1994 | Cronin et al. | |
| 5,358,909 | A | 10/1994 | Hashiguchi et al. | |
| 5,541,473 | A | 7/1996 | Duboc, Jr. et al. | |
| 5,543,684 | A | 8/1996 | Kumar et al. | |

(Continued)

FOREIGN PATENT DOCUMENTS

EP 0 443 865 A1 8/1991

(Continued)

OTHER PUBLICATIONS

Drouhin H-J et al: "Spin-polarized photoelectron sources and spin-dependent free- electron injection through ultrathin ferromagnetic layers", *9TH International Vacuum Microelectronics Conference* pp. 252-257 (1996).

(Continued)

*Primary Examiner*—Peter Macchiarolo
(74) *Attorney, Agent, or Firm*—Morrison & Foerster LLP

(57) ABSTRACT

An electrons' emission device is presented. The device comprises an electrodes' arrangement including at least one Cathode electrode and at least one Anode electrode, the Cathode and Anode electrodes being arranged in a spaced-apart relationship; the device being configured to expose said at least one Cathode electrode to exciting illumination to thereby cause electrons' emission from said Cathode electrode, the device being operable as a photoemission switching device.

53 Claims, 8 Drawing Sheets

U.S. PATENT DOCUMENTS

| | | | | |
|---|---|---|---|---|
| 5,548,181 | A * | 8/1996 | Jones | 313/309 |
| 5,551,903 | A | 9/1996 | Kumar et al. | |
| 5,572,042 | A | 11/1996 | Thomas et al. | |
| 5,616,061 | A | 4/1997 | Potter | |
| 5,618,216 | A | 4/1997 | Potter | |
| 5,629,580 | A | 5/1997 | Mandelman et al. | |
| 5,630,741 | A | 5/1997 | Potter | |
| 5,644,188 | A | 7/1997 | Potter | |
| 5,644,190 | A | 7/1997 | Potter | |
| 5,647,998 | A | 7/1997 | Potter | |
| 5,652,474 | A | 7/1997 | Wilshaw et al. | |
| 5,663,608 | A | 9/1997 | Jones et al. | |
| 5,700,176 | A | 12/1997 | Potter | |
| 5,703,380 | A | 12/1997 | Potter | |
| 5,713,774 | A | 2/1998 | Thomas et al. | |
| 5,736,810 | A | 4/1998 | Mandelman et al. | |
| 5,751,097 | A | 5/1998 | Mandelman et al. | |
| 5,751,109 | A * | 5/1998 | Payne | 313/542 |
| 5,793,155 | A | 8/1998 | Vasche | |
| 5,811,929 | A | 9/1998 | Potter | |
| 5,834,790 | A | 11/1998 | Suzuki | |
| 5,888,113 | A | 3/1999 | Anderson et al. | |
| 5,920,148 | A | 7/1999 | Potter | |
| 5,943,111 | A | 8/1999 | McMillan | |
| 5,969,480 | A | 10/1999 | Schmolla et al. | |
| 5,973,259 | A | 10/1999 | Edelson | |
| 5,989,931 | A | 11/1999 | Ghodsian et al. | |
| 6,037,708 | A | 3/2000 | Potter | |
| 6,046,714 | A | 4/2000 | Lim | |
| 6,132,278 | A | 10/2000 | Kang et al. | |
| 6,169,358 | B1 | 1/2001 | Jones et al. | |
| 6,198,225 | B1 | 3/2001 | Kano et al. | |
| 6,215,242 | B1 | 4/2001 | Janning | |
| 6,218,777 | B1 | 4/2001 | Jones et al. | |
| 6,220,914 | B1 | 4/2001 | Lee et al. | |
| 6,317,106 | B1 | 11/2001 | Beeteson et al. | |
| 6,329,753 | B1 | 12/2001 | Makhov | |
| 6,437,360 | B1 | 8/2002 | Cho et al. | |
| 6,440,763 | B1 | 8/2002 | Hsu | |
| 6,441,542 | B1 | 8/2002 | Hush et al. | |
| 6,448,701 | B1 | 9/2002 | Hsu | |
| 6,472,802 | B1 | 10/2002 | Choi et al. | |
| 6,504,530 | B1 | 1/2003 | Wilson et al. | |
| 6,580,223 | B2 | 6/2003 | Konishi et al. | |
| 2001/0035712 | A1 | 11/2001 | Berman et al. | |
| 2002/0074934 | A1 | 6/2002 | Beeteson et al. | |
| 2002/0125805 | A1 | 9/2002 | Hsu | |
| 2003/0075767 | A1 | 4/2003 | Lannon, Jr. et al. | |
| 2003/0082983 | A1 | 5/2003 | Hwang et al. | |

FOREIGN PATENT DOCUMENTS

| | | | |
|---|---|---|---|
| EP | 0 476 975 | A1 | 3/1992 |
| GB | 347544 | | 4/1931 |
| JP | 3-295131 | A | 12/1991 |
| JP | 4-212236 | A | 8/1992 |
| RU | 2 018 191 | C1 | 8/1994 |
| RU | 1 664 083 | C | 1/1995 |
| RU | 2 032 250 | C1 | 3/1995 |
| RU | 2 072 591 | C1 | 1/1997 |
| RU | 2 078 390 | C1 | 4/1997 |
| RU | 98106151 | | 2/2000 |
| RU | 2 194 334 | C1 | 12/2002 |
| WO | 94/03916 | A1 | 2/1994 |
| WO | WO 96/10835 | | 4/1996 |
| WO | 96/19663 | A1 | 6/1996 |
| WO | 96/36061 | A1 | 11/1996 |
| WO | 96/42113 | A1 | 12/1996 |
| WO | WO 96/41322 | | 12/1996 |
| WO | 97/02586 | A1 | 1/1997 |

OTHER PUBLICATIONS

XP000542029 Drouhin H-J et al: "Electron transmission through ultra-thin metal layers and its spin dependence for magnetic structures" *Journal of Magnetism and Magnetic Materials*, vol. 151 No. 3, pp. 417-426, (1995).

Brodie, I., "Keynote Address to the First International Vacuum Microelectronics Conference, Jun. 1988: Pathways to Vacuum Microelectronics", *IEEE Transactions on Electron Devices*, vol. 36, No. 11, pp. 2637-2640, (1989).

Brodie, I., et al., "Advances in Electronics and Electron Physics: Microelectronics and Microscopy", Academic Press, New York, vol. 83, pp. 1-106, (1992).

Fowler, R.H., et al., "Electron Emission in Intense Electric Fields", *Proceedings of the Royal Society of London*, Series A, vol. 119, No. 781, pp. 173-181, (1928).

Sze, S.M., "Physics of Semiconductor Devices", John Wiley & Sons, $2_{nd}$ Edition, New York, pp. 27-35, 341-343.

Utsumi, T., "Keynote Address Vacuum Microelectronics: What's New and Exciting", *IEEE Transactions on Electron Devices*, vol. 38, No. 10, pp. 2276-2283, (1991).

Iannazzo, S., "Review: A Survey of the Present Status of Vacuum Microelectronics", *Solid-State Electronics*, vol. 36, No. 3, pp. 301-320, (1993).

Lassailly, Y., et al., "Spin-dependent transmission of low-energy electrons through ultrathin magnetic layers", *The American Physical Society: Physical Review B*, vol. 50, No. 17, pp. 13054-13057, (1994).

Brodie, I., "Physical Considerations in Vacuum Microelectronics Devices" *IEEE Transactions on Electron Devices*, vol. 36, No. 11, pp. 2641-2644, (1989).

* cited by examiner

ELECTRONIC SWITCHING DEVICE

This application claims the benefit of prior U.S. provisional patent application No. 60/488,797 filed Jul. 22, 2003 and 60/517,387 filed Nov. 6, 2003, the contents of which are hereby incorporated by reference in their entirety.

FIELD OF THE INVENTION

This invention relates to an electron emission device, such as a diode or triode structure.

BACKGROUND OF THE INVENTION

Diode and triode devices are widely used in the electronics. One class of these devices utilize the principles of vacuum microelectronics, namely, their operation is based on ballistic movement of electrons in vacuum [Brodie, Keynote address to the first international vacuum microelectronics conference, June 1988, IEEE Trans. Electron Devices, 36, 11 pt. 2 2637, 2641 (1989); I. Brodie, C. A. Spindt, in "Advances in Electronics and Electron Physics", vol. 83 (1992), p. 1-106]. According to the principles of vacuum microelectronics, electrons are ejected from a cathode electrode by field emission and tunnel through the barrier potential, when a very high electric field (more than 1 V/nm) is locally applied [R. H. Fowler, L. W Nordheim, Proc. Royal Soc. London A119 (1928), p. 173].

U.S. Pat. No. 5,834,790 discloses a vacuum microdevice having a field-emission cold cathode. This device includes first electrode and second electrodes. The first electrode has a projection portion with a sharp tip. An insulating film is formed in the region of the first electrode, excluding the sharp tip of the projection portion. The second electrode is formed in a region on the insulating film, excluding the sharp tip of the projection portion. A structural substrate is bonded to the lower surface of the first electrode and has a recess portion in the bonding surface with the lower surface of the first electrode. The recess portion has a size large enough to cover a recess reflecting the sharp tip of the projection portion formed on the lower surface of the first electrode. The interior of the recess portion formed in the structural substrate communicates with the atmosphere outside the device. A support structure is formed on the surface of the second electrode to surround each projection portion formed on the first electrode. With this structure, a vacuum microdevice can be provided which can suppress variations in characteristics due to voids and exhibit excellent long-term reliability.

Triodes (transistors) of another class are semiconductor devices based on the principles of "solid state microelectronics", where the charge carriers are confined within solids and are impaired by interaction with the lattice [S. M. Sze, Physics of semiconductor devices, Interscience, $2^{nd}$ edition, New York]. In the devices of this kind, a current is conducted within semiconductors, so the moving velocity of electrons is affected by the crystal lattices or impurities therein. A fundamental drawback of active electronic devices based on semiconductors is that electrons transport is impeded by the semiconductor crystal lattice, which places a limit on both the miniaturization and the switching speed of such devices.

Vacuum microelectronic devices have potential advantages over solid-state microelectronic devices. Vacuum microelectronic devices have a high degree of immunity to hostile environment conditions (such as temperature and radiation) since they are based only on metals and dielectrics. These devices can achieve very high operation frequencies, because the electrons' velocity is not limited by interactions with the lattice [T. Utsumi, IEEE Tans. Electron Devices, 38,10,2276 (1991)]. In general, vacuum microelectronics devices have excellent output circuit (power delivery loop) characteristics: low output conductance, high voltage and high power handling capability. However, their input circuit (control loop) characteristics are relatively poor: they have low current capabilities, low transconductance, high modulation/turn-on voltage and poor noise characteristics. As a result, despite the: tremendous research efforts in this field, these devices found only very few applications, especially as RF signal amplifiers and sources [S. Iannazzo, Solid State Electronics, 36, 3, 301 (1993)].

Most of the current electronics is based on devices which are made from Si or compound semiconductor based structures. Because of the intrinsic resistivity of these devices, the electrons' transmission through the device causes the creation of heat. This heat is the main obstacle in the attempts to maximize the number of transistors within an integrated circuit per a given area.

Semiconductor devices utilizing microtip type vacuum transistors have been developed. Here, electrons move in vacuum and thus, at the highest speed. Therefore, the vacuum transistors can be operated at ultra speeds. However, they suffer from disadvantages in that they are unstable, have relatively short lifetime, and require relatively high voltages for their operation.

U.S. Pat. No. 6,437,360 discloses a MOSFET-like flat or vertical transistor structure presenting a Vacuum Field Transistor (VFT), in which electrons travel a vacuum free space, thereby realizing the high speed operation of the device utilizing this structure. The flat type structure is formed by a source and a drain, made of conductors, which stand at a predetermined distance apart on a thin channel insulator with a vacuum channel therebetween; a gate, made of a conductor, which is formed with a width below the source and the drain, the channel insulator functioning to insulate the gate from the source and the drain; and an insulating body, which serves as a base for propping up the channel insulator and the gate. The vacuum field transistor comprises a low work function material at the contact regions between the source and the vacuum channel and between the drain and the vacuum channel. The vertical type structure comprises a conductive, continuous circumferential source with a void center, formed on a channel insulator; a conductive gate formed below the channel insulator, extending across the source; an insulating body for serving as a base to support the gate and the channel insulator; an insulating walls which stand over the source, forming a closed vacuum channel; and a drain formed over the vacuum channel. In both types, proper bias voltages are applied among the gate, the source and the drain to enable electrons to be field emitted from the source through the vacuum channel to the drain.

SUMMARY OF THE INVENTION

There is a need in the art to significantly improve the performance of electronic devices in general and transistors in particular and facilitate their manufacture and operation, by providing a novel electron emission device.

The electron emission device according to the present invention is based on a new technology, which allows for eliminating the need for or at least significantly reducing the requirements to vacuum environment inside the device, allows for effective device operation with a higher distance between Cathode and Anode electrodes, as well as more stable and higher-current operation, as compared to the conventional devices of the kind specified, practically does not suffer from large energy dissipation, and is robust vis a vis radiation. This is achieved by utilizes the photoelectric effect, according to which photons are used for ejecting electrons from a solid conductive material, provided the photon energy exceeds the work-function of this conductive material.

The device of the present invention is configured as an electron emission switching device. The term "switching" signifies affecting a change in an electric current through the device (current between Cathode and Anode), including such effects as shifting between operational and inoperational modes, modifying the electric current, amplifying the current, etc. Such a switching may be implemented by varying the illumination of Cathode while keeping a certain potential difference between the electrodes of the device, or by varying a potential difference between the electrodes of the device while maintaining illumination of the Cathode, or by a combination of these techniques.

According to one broad aspect of the present invention, there is provided an electron emission device comprising an electrodes' arrangement including at least one Cathode electrode and at least one Anode electrode, the Cathode and Anode electrodes being arranged in a spaced-apart relationship; the device being configured to expose said at least one Cathode electrode to exciting illumination to thereby cause electrons' emission from said Cathode electrode, the device being operable as a photoemission switching device.

A gap between the first and second electrodes may be a gas-medium gap (e.g., air) or vacuum gap. A gas pressure in the gap is sufficiently low to ensure that a mean free path of electrons accelerating from the Cathode to the Anode is larger than a distance between the Cathode and the Anode electrodes (larger than the gap length).

The electrodes may be made from metal or semiconductor materials. Preferably, the Cathode electrode has a relatively low work function or a negative electron affinity (like in diamond and cesium coated GaAs surface). This can be achieved by making the electrodes from appropriate materials or/and by providing an organic or inorganic coating on the Cathode electrode (a coating that creates a dipole layer on the surface which reduces the work function).

The Cathode electrode may be formed with a portion thereof having a sharp edge, e.g., of a cross-sectional dimension substantially not exceeding 60 nm (e.g., a 30 nm radius).

The device is associated with a control unit, which operates to effect the switching function. The control unit may operate to maintain illumination of the Cathode electrode and to affect the switching by affecting a potential difference between the Cathode and Anode and thereby affect an electric current between them. Alternatively, the control unit may effect the switching function by appropriately operating the illuminating assembly to cause a change in the illumination, and thus affect the electric current.

The electrodes' arrangement may include an array (at least two) Cathode electrodes associated with one or more Anode electrodes; or an array (at least two) Anode electrodes associated with the same Cathode electrode. Considering for example, multiple Anode and single Cathode arrangement, the control unit may operate to maintain illumination of the Cathode electrode and to control an electric current between the Cathode electrode and each of the Anode electrodes by varying a potential difference between them. Generally speaking, various combinations of Cathode and Anode electrodes may be used in the device of the present invention, for example the electrodes' arrangement may be in form of a pixilated structure. The Cathode and Anode electrodes may be accommodated in a common plane or in different planes, respectively.

The electrodes' arrangement may include at least one additional electrode (Gate) electrically insulated from the Cathode and Anode electrodes. The Gate electrode may and may not be planar (e.g., cylindrically shaped). The Gate electrode may be configured as a grid located between the Cathode and Anode electrodes. The Gate electrode may be accommodated in a plane spaced-apart and parallel to a plane where the Cathode and Anode electrodes are located; or the Cathode, Anode and gate electrodes are all located in different planes.

The Gate electrode may be used to control an electric current between the Cathode and Anode electrodes. For example, the control unit operates to maintain certain illumination of the Cathode, and affect the electric current between the Cathode and Anode (kept at a certain potential difference between them) by varying a voltage supply to the Gate.

The electrodes' arrangement may include an array of Gate electrodes arranged in a spaced-apart relationship and electrically insulated from the Cathode and Anode electrodes. The device may for example be operable to implement various logical circuits, or to sequentially switch various electric circuits.

Generally, the electrodes arrangement may be of any suitable configuration, like tetrode, pentode, etc., for example designed for lowering capacitance.

The electrodes' arrangement may include an array of Anode electrodes associated with a pair of Cathode and Gate electrodes. For example, the control unit operates to maintain certain illumination of the Cathode electrode, and control an electric current between the Cathode and the Anode electrodes by varying a voltage supply to the Gate electrode.

The illuminating assembly may include one or more light sources, and/or utilize ambient light. In some non limiting examples, the illuminating assembly may include a low pressure discharge lamp (e.g., Hg lamp), and/or a high pressure discharge lamp (e.g., a Xe lamp), and/or a continuous wave laser device, and/or a pulsed laser device (e.g., high frequency), and/or at least one non-linear crystal, and/or at least one light emitting diode.

The Cathode and Anode electrode may be made from ferromagnetic materials, different in that their magnetic moment directions are opposite, thus enabling implementation of a spin valve (Phys Rev. B, Vol. 50, pp. 13054, 1994). The device may thus be shiftable between its inoperative and operative positions by shifting one of the Cathode and Anode electrodes between its SPIN UP and SPIN DOWN states. To this end, the device includes a magnetic field source operable to apply an external magnetic field to the electrodes' arrangement. The application of the external magnetic field shifts one of the electrodes between its SPIN UP and SPIN DOWN states.

The Cathode electrode may be made from non-ferromagnetic metal or semiconductor and the Anode electrode from a ferromagnetic material. In this case, the illuminating assembly is configured and operable to generate circular polarized light to cause emission of spin polarized electrons from the Cathode. The device is shiftable between its operative and inoperative positions by varying the polarization of light illuminating the Cathode, or by shifting the Anode electrode between SPIN UP and SPIN DOWN high-transmission states. The change in polarization of illuminating light may be achieved by using one or more light sources emitting light of specific polarization and a polarization rotator (e.g., $\lambda/4$ plate) in the optical path of emitted light; or by using light sources emitting light of different polarization, respectively, and selectively operating one of the light sources.

The Cathode electrode may be located on a substrate transparent for a wavelength range used to excite the Cathode electrode. In this case, the illuminating assembly may be oriented to illuminate the Cathode electrode through the transparent substrate. Alternatively or additionally, a substrate carrying the Anode electrode (and possibly also the Anode electrode) may be transparent and located in a plane spaced from that of the Cathode, thereby enabling illumination of the Cathode through the Anode-carrying substrate regions outside the Anode (or through the Anode-carrying substrate and the Anode, as the case may be).

Based on the recent developments in nano-technology, in general, and in optical lithography in particular, the device of the present invention can be manufactured as a low-cost submicron structure. The electrodes' arrangement is an integrated structure including first and second substrate layers for carrying the Cathode and Anode electrodes; and a spacer layer structure between the first and second substrate layers. The spacer layer structure is patterned to define a gap between the Cathode and Anode electrodes. The spacer layer structure may include at least one dielectric material layer. For example, the spacer layer structure includes first and second dielectric layers and an electrically conductive layer (Gate) between them. Either one of the first and second substrates or both of them are made of a material transparent with respect to the exciting wavelength range thereby enabling illumination of the Cathode.

The electrodes' arrangement may be an integrated structure configured to define an array of sub-units, each sub-unit being constructed as described above. Namely, the integrated structure includes a first substrate layer for carrying an array of the spaced-apart Cathode electrodes; a second substrate layer for carrying an array of the spaced-apart Anode electrodes; and a spacer layer structure between the first and second substrate layers. The spacer layer structure is patterned to define an array of spaced-apart gaps between the first and second arrays of electrodes.

According to another aspect of the invention, there is provided, an electron emission device comprising an electrodes' arrangement including at least one Cathode electrode and at least one Anode electrode arranged in a spaced-apart relationship; the device being configured to expose said at least one Cathode electrode to exciting illumination to cause electron emission therefrom, the device being operable as a photoemission switching device by affecting an electric current between the Cathode and Anode electrodes, the switching being effectible by at least one of the following: varying the illumination of the:the Cathode electrode, and varying an electric field between the Cathode and Anode electrodes.

The electric field may be varied by varying a potential difference between the Cathode and Anode electrodes, or when using at least one Gate electrode by varying a voltage supply to the Gate electrode.

According to yet another aspect of the invention, there is provided, an electron emission device comprising an electrodes' arrangement including at least one Cathode electrode, at least one Anode electrode, and at least one additional electrode arranged in a spaced-apart relationship; the device being configured to expose said at least one Cathode electrode to exciting illumination to thereby cause electrons' emission from said at least one illuminated Cathode electrode towards said at least one Anode electrode; the device being operable as a photoemission switching device by affecting an electric current between the Cathode and Anode electrodes, the switching being effectible by at least one of the following: varying the illumination of the Cathode electrode, and varying an electric field between the Cathode and Anode electrodes.

According to yet another aspect of the invention, there is provided, an electron emission device comprising an electrodes' arrangement including at least one Cathode electrode and at least one Anode electrode, the Cathode and Anode electrodes being arranged in a spaced-apart relationship with a gas-medium gap between them; the device being configured to expose said at least one Cathode electrode to exciting illumination to thereby cause electrons' emission from said at least one illuminated Cathode electrode, the device being operable as a photoemission switching device.

According to yet another aspect of the invention, there is provided an electron emission device comprising an electrodes' arrangement including at least one Cathode electrode, at least one Anode electrode, and at least one additional electrode arranged in a spaced-apart relationship; the device being configured to expose said at least one Cathode electrode to exciting illumination to thereby cause electrons' emission from said at least one illuminated Cathode electrode towards said at least one Anode electrode; the device being operable as a photoemission switching device According to yet another aspect of the invention, there is provided an integrated device comprising at least one structure operable as an electrons' emission unit, said at least one structure comprising at least one Cathode electrode and at least one Anode electrode that are carried by first and second substrate layers, respectively, which are spaced from each other by a spacer layer structure including at least one dielectric layer, the spacer layer structure being patterned to define a gap between the Cathode and Anode electrodes, at least one of the first and second substrates being made of a material transparent with respect to certain exciting radiation to thereby enable illumination of the at least one Cathode electrode to cause electrons emission therefrom, the device being operable as a photoemission switching device.

According to yet another aspect of the invention, there is provided an integrated device comprising at least one structure operable as an electrons' emission unit, said at least one structure comprising at least one Cathode electrode and at least one Anode electrode that are carried by first and second substrate layers, respectively, which are spaced from each other by a spacer layer structure including first and second dielectric layers and an electrically conductive layer between the dielectric layers, the spacer layer structure being patterned to define a gap between the Cathode and Anode electrodes, at least one of the first and second substrates being made of a material transparent with respect to certain exciting radiation to thereby enable illumination of the Cathode electrode to cause electrons emission therefrom, the device being operable as a photoemission switching device.

According to yet another aspect of the invention, there is provided an integrated device comprising an array of structures operable as electrons' emission units, the device comprising a first substrate layer carrying the array of the spaced-apart Cathode electrodes, a second substrate layer carrying the array of the spaced-apart Anode electrode; and a spacer layer structure between said first and second substrates, the spacer layer structure including at least one dielectric layer and being patterned to define an array of gaps, each between the respective Cathode and Anode electrodes, at least one of the first and second substrates being made of a material transparent with respect to certain exciting radiation to thereby enable illumination of the Cathode electrode to cause electrons emission therefrom, the device being operable as a photoemission switching device.

According to yet another aspect of the invention, there is provided, a method of operating an electron emission device as a photoemission switching device, the method comprising illuminating a Cathode electrode by certain exciting radiation to cause electrons' emission from the Cathode electrode towards an Anode electrode, and affecting the switching by at least one of the following: controllably varying the illumination of the Cathode, and controllably varying an electric field between the Cathode and Anode electrodes.

As indicated above, Cathode and Anode electrodes may be spaced from each other by a gas-medium gap (e.g., air, inert gas). Such a device may and may not utilize the photoelectric effect. Thus device is based on a new technology, the so-called "gas-nano-technology". This technique is free of the drawbacks of the vacuum microelectronics, and, contrary to the existing semiconductor based electronics, does not suffer from large energy dissipation, and is robust vis a vis radiation. Such a gas-nano device of the present invention provides for electrons' passage in air or another gas environment. The device may be configured and operable as a switching device, or a display device.

Thus, according to yet another aspect of the invention, there is provided an electron emission device comprising an electrodes' arrangement including at least one unit having at least one Cathode electrode and at least one Anode electrode that are arranged in a spaced-apart relationship, the Anode and Cathode electrodes being spaced from each other by a gas-medium gap substantially not exceeding a mean free path of electrons in said gas medium.

BRIEF DESCRIPTION OF THE DRAWINGS

In order to understand the invention and to see how it may be carried out in practice, preferred embodiments will now be described, by way of non-limiting example only, with reference to the accompanying drawings, in which:

FIGS. 7A to 7C show another experimental results illustrating the features of the present invention, wherein FIG. 7A shows an electron photoemission switching device of the present invention designed as a simple planar triode structure; and FIGS. 7B and 7C show the measurement results: FIG. 7B shows the volt-ampere characteristics measured on the Anode for different voltages on the Gate-grid, and FIG. 7C shows the Anode current as a function of the Gate voltage for different voltages on the Anode;

FIGS. 8A to 8E exemplify the implementation of an electron photoemission switching device of the present invention in a micron scale, wherein FIG. 8A shows a device presenting a basic unit of a multiple-units device of FIG. 8B; and FIGS. 8C-8E show electrostatic simulation of the operation of the device of FIG. 8A.

DETAILED DESCRIPTION OF THE INVENTION

Figure 1:
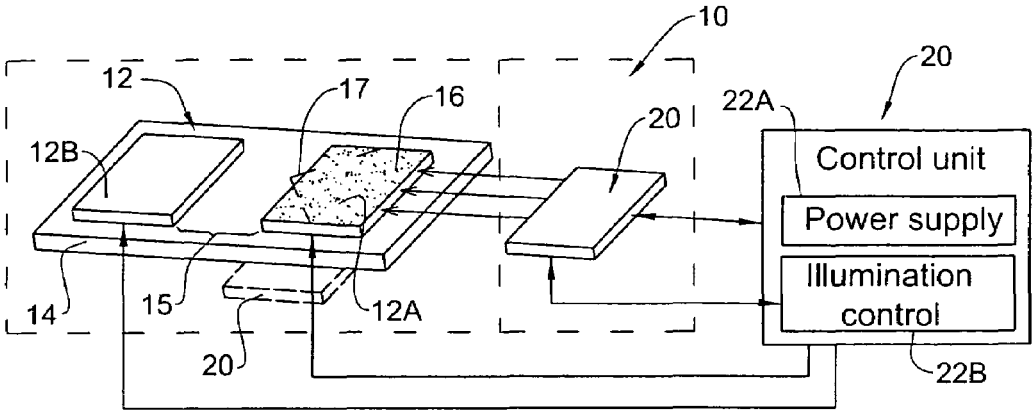
FIG. 1 is a schematic illustration of an electron photoemission switching device according to one embodiment of the invention, operable as a diode structure.

Referring to FIG. 1, there is schematically illustrated an electronic device 10 constructed according to one embodiment of the invention. The device is configured and operable as an electron photoemission switching device. In the present example, the device has a diode structure configuration. The device 10 comprises an electrodes' arrangement 12 formed by a first Cathode electrode 12A and a second Anode electrode 12B that are arranged on top of a substrate 14 in a spaced-apart relationship with a gap 15 between them. The device is configured to expose the Cathode 12A to exciting radiation to cause electrons emission therefrom towards the Anode. As shown in the present example, the device includes an illuminator assembly 20 oriented and operable to illuminate at least the Cathode electrode 12A to thereby cause emission of electrons from the Cathode towards the Anode.

The switching (i.e., affecting of an electric current between the Cathode and Anode) is controlled by the illumination of the Cathode electrode and appropriate application of an electric field between the Anode and Cathode electrodes. For example, the Cathode and Anode may be kept at a certain potential difference between them, and switching is achieved by modifying the illumination intensity. Another example to effect the switching is by varying the potential difference between the electrodes, while maintaining certain illumination intensity. Yet another example is to modify both the illumination and the potential difference between the electrodes. It should be noted that modifying the illumination may be achieved in various ways, for example by modifying the operational mode of a light emitting assembly, by modifying polarization or phase of emitted light, etc. The device 10 is associated with a control unit 22 including inter alia a power supply unit 22A for supplying voltages to the Cathode and Anode electrodes, and an appropriate illumination control utility 22B for operating the illuminator 20.

The Cathode and Anode electrodes 12A and 12B may be made of metal or semiconductor materials. The Cathode electrode 12A is preferably a reduced work function electrode. Negative electron affinity (NEA) materials can be used (e.g., diamond), thus reducing the photon energy (exciting energy) necessary to induce photoemission. Another way to reduce the work function is by coating or doping the Cathode electrode 12A with an organic or inorganic material (a coating 16 being exemplified in the figure in dashed lines) that reduces the work function. For example, this may be metal, multi-alkaline, bi-alkaline, or any NEA material, or GaAs electrode with cesium coating or doping thereby obtaining a work function of about 1-2 eV. The organic or inorganic coating also serves to protect the Cathode electrode from contamination.

The illuminator assembly 20 can include one or more light sources operable with a wavelength range including that of the exciting illumination for the Cathode electrode used in the device. This may be, but not limited to, a low pressure lamp (e.g., Hg lamp), other lamps (e.g. high pressure Xe lamp), a continuous wave (CW) laser or pulse laser (high frequency pulse), one or more non-linear crystals, or one or more light emitting diodes (LEDs), or any other light source or a combination of light sources.

Light produced by the illuminator assembly 20 can be directly applied to the electrode(s) or through the transparent substrates 14 (as shown in the figure in dashed lines).

The Cathode and Anode electrodes 12A and 12B may be spaced from each other by the vacuum or gas-medium (e.g., air, inert gas) gap 15. As shown in the figure by dashed lines, the entire device 10, or only electrodes' arrangement thereof, can be encapsulated and filled with gas. It should be understood that the gas pressure is low enough to ensure that a mean free path of electrons accelerating from the Cathode to the Anode is larger than a distance (the length of the gap 15) between the Cathode and the Anode electrodes, thereby eliminating the need for vacuum between the electrodes or at least significantly reducing the vacuum requirements. For example, for a 10 micron gap between the Cathode and Anode layers, a gas pressure of a few mBar may be used. In other words, the length of the gap 15 between the electrodes 12A and 12B substantially does not exceed a mean free path of electrons in the gas environment It should however be understood that the principles of the present invention (the Cathode illumination) can advantageously be used in the conventional vacuum-based field emission device to thereby significantly reduce the requirements to a low work function of the Cathode electrode material, and/or geometry, and/or to reduce the need for a high electric field.

As shown in FIG. 1 in dashed lines, the Cathode electrode 12A may be designed to have a very sharp edge 17, e.g., substantially not exceeding 60 nm in a cross-sectional dimension (e.g., with a radius less than about 30 nm). Such a design of the Cathode is typically used to enable the device operation at lower electric potential as compared to that with the flat-edge Cathode. It is, however, important to note that the use of illumination of the Cathode practically eliminates the need for making the Cathode with a sharp edge. Comparing the device of the present invention (where illumination of the Cathode is used) to the convention devices of the kind specified, the device of the present invention is characterized by better current stability and less sensitivity to the changes in the electrodes' surface effects, as well as the possibility of achieving effective device operation at a larger distance between the Cathode and Anode, lower applied field, and no need for a sharp edge of the Cathode. The use of Cathode illumination provides for operating with lower voltages, i.e., energy of electrons reaching the Anode is lower, thus preventing such undesirable effects for Anode electrode as sputtering and evaporation.

Figure 2:
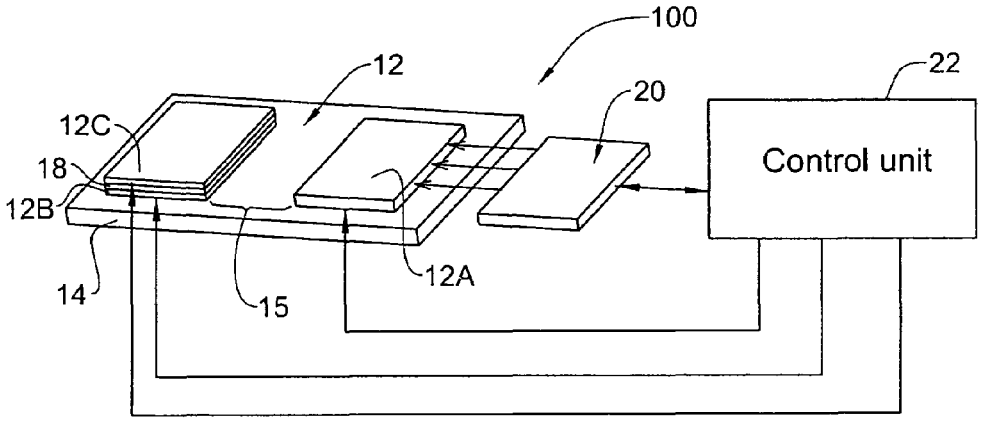
FIG. 2 is a schematic illustration of an electron photoemission switching device according to another embodiment of the invention designed as a triode structure.

FIG. 2 schematically illustrates an electron photoemission switching device 100 of the present invention designed as a triode structure. To facilitate understanding, the same reference numbers are used for identifying components which are common in all the examples of the invention. The device 100 includes an electrodes' arrangement 12 formed by Cathode and Anode electrodes 12A and 12B spaced from each other by a gap 15 (vacuum or gas-medium gap), and a Gate electrode 12C electrically insulated from the Cathode and Anode electrodes. In the present example, the Gate electrode 12C is located above the Anode 12B being spaced therefrom by an insulator 18. An electrons' extractor (illuminator) 20 is provided being accommodated so as to illuminate at least the Cathode electrode, either directly (as shown in the figure) or via an optically transparent substrate 14.

In the configuration of FIG. 2, the electrodes 12B and 12C serve as, respectively, Anode and switching control element. More specifically, a change in an electric current between the Cathode and Anode is affected by a selective voltage supply to the Gate, while certain illumination of Cathode and a certain potential difference between the Cathode and Anode are maintained.

It should, however, be understood that switching can be realized using another configurations as well. For example by switching electrodes 12B and 12C, by making electrodes 12B and 12C side by side, by omitting the "Gate" electrode 12C at all and controlling the electric current between electrodes 12A and 12B by the voltage supply-between them (as shown in the configuration of FIG. 1), and/or by varying the illumination intensity.

Figure 3A:
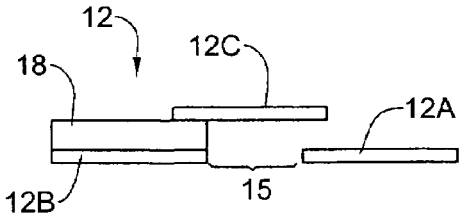
FIGS. 3A-3C show several examples of the electrodes' arrangement design suitable to be used in the device of FIG. 2.
Figure 3B:
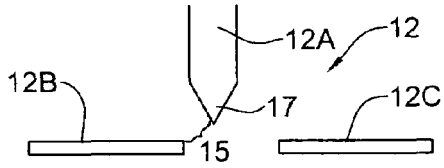
Figure 3C:
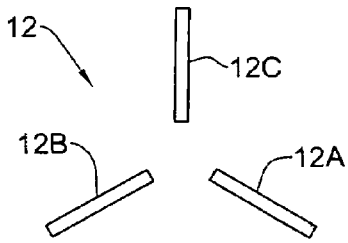

FIGS. 3A-3C show in a self-explanatory manner several possible but not limiting examples of the electrodes' arrangement design suitable to be used in the device 100.

Figure 4:
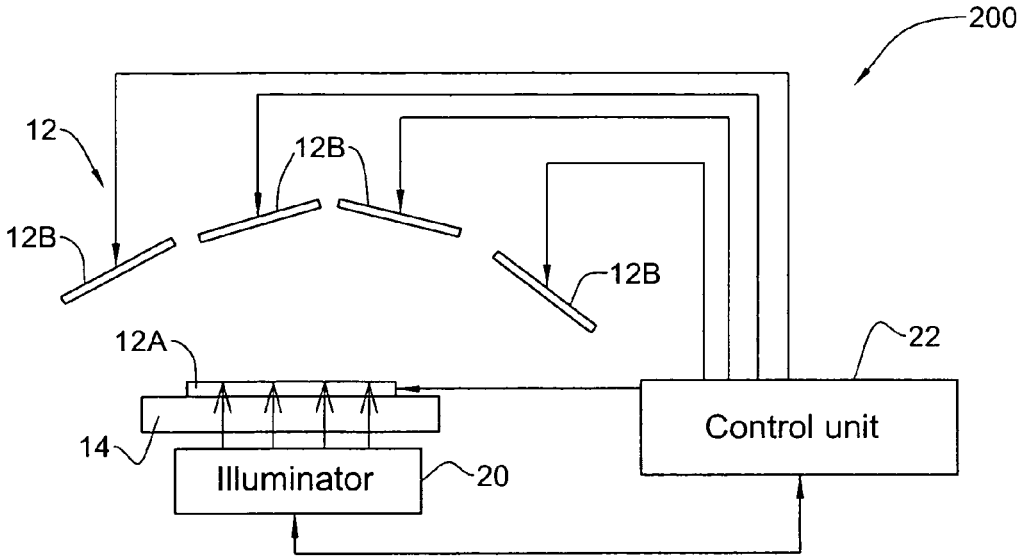
FIG. 4 exemplifies yet another configuration of an electron photoemission switching device of the present invention, where the electrodes' arrangement includes an array of Anode electrodes associated with a common Cathode electrode.

FIG. 4 exemplifies another configuration of an electron photoemission switching device, generally designated 200, of the present invention. Here, an electrodes' arrangement 12 includes a Cathode electrode 12A and an array (generally at least two) spaced-apart Anode electrodes 12B—four such Anode electrodes arranged in an arc-like or circular array being shown in the present example. The Anode electrodes 12B are appropriately spaced from the Cathode electrode 12A depending on whether a vacuum or gas-medium gap between them is used, as described above. An illuminator 20 is accommodated so as to illuminate the Cathode layer, which in the present example is implemented via an optically transparent substrate 14 carrying the Cathode electrode thereon. Each of the Cathode and Anode electrodes is separately addressed by the power supply. During the device operation, a control unit 22 operates the illuminator to maintain certain (or controllably vary) illumination of the Cathode electrode and thereby enable electrons extraction therefrom, and to selectively apply a potential difference between the Cathode and the respective Anode electrode. By this, a data stream sequence can be created/multiplexed.

Figure 5:
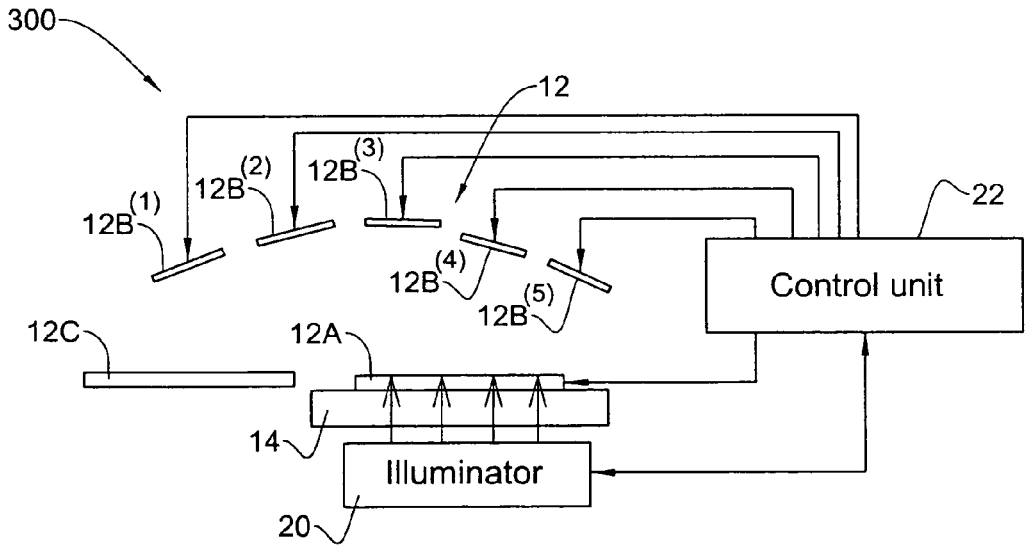
FIG. 5 schematically illustrates yet another configuration an electron photoemission switching device of the present invention.

Reference is made to FIG. 5 schematically illustrating yet another configuration of a electron photoemission switching device 300 of the present invention. The device 300 includes an electrodes' arrangement 12 and an illuminator 20. The electrodes' arrangement 12 includes a Cathode electrode 12A, and either a single Anode and multiple Gate electrodes or a single Gate and multiple Anode electrodes. In the present example, a Gate electrode 12C and an array of N Anode electrodes are used—five such Anode electrodes 12B$^{(1)}$-12B$^{(5)}$ being shown in the figure. The illuminator 20 is accommodated to illuminate the Cathode electrode 12A. In the present example, the device is configured to allow Cathode illumination through the transparent substrate 14. A data stream sequence can be created/multiplexed by varying a voltage supply to the Gate 12C, while maintaining a certain voltage supply to the Cathode and Anode electrodes and maintaining certain illumination (or controllably varying the illumination) of the Cathode electrode 12A. The variation of the Gate 12C voltage determines the electrons path from the Cathode to the Anode electrodes: increasing the absolute value of negative voltage on the Gate 12C results in sequential electrons passage from the Cathode to, respectively, Anode electrodes. 12B$^{(1)}$, 12B$^{(2)}$, 12B$^{(3)}$, 12B$^{(4)}$, 12B$^{(5)}$.

Figure 6:
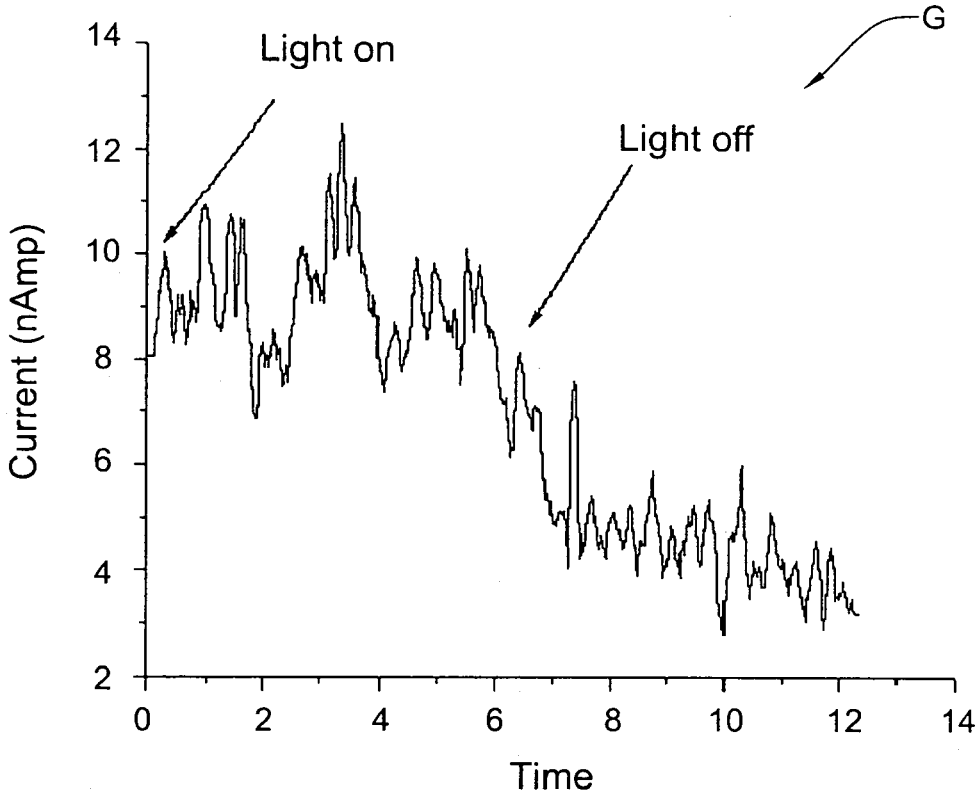
FIG. 6 illustrates the experimental results of the operation of an electron emission device of the present invention configured as the device of FIG. 1.

FIG. 6 illustrates the experimental results of the operation of an electrons' emission device configured as the above-described device 10 of FIG. 1. A graph G presents the time variation of an electric current through the device while shifting the illuminating assembly (20 in FIG. 1) between its operative (Light On) and inoperative (Light OFF) positions. In the present example, the Cathode and Anode electrodes are 45nm spaced from each other, and kept at 4.5V potential difference between them.

Figure 7A:
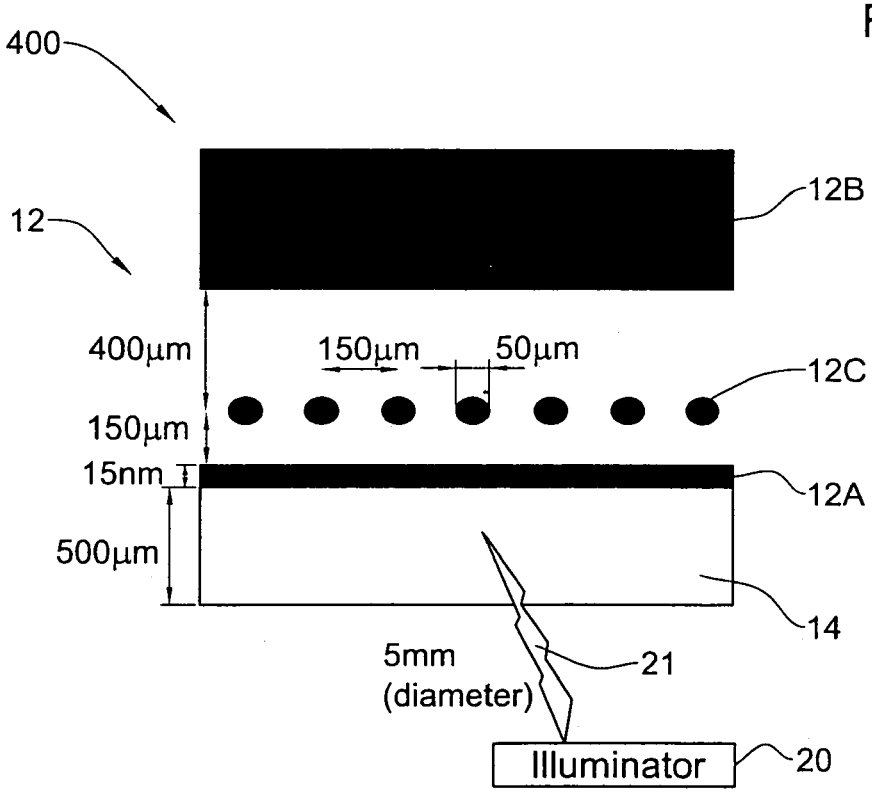
Figure 7B:
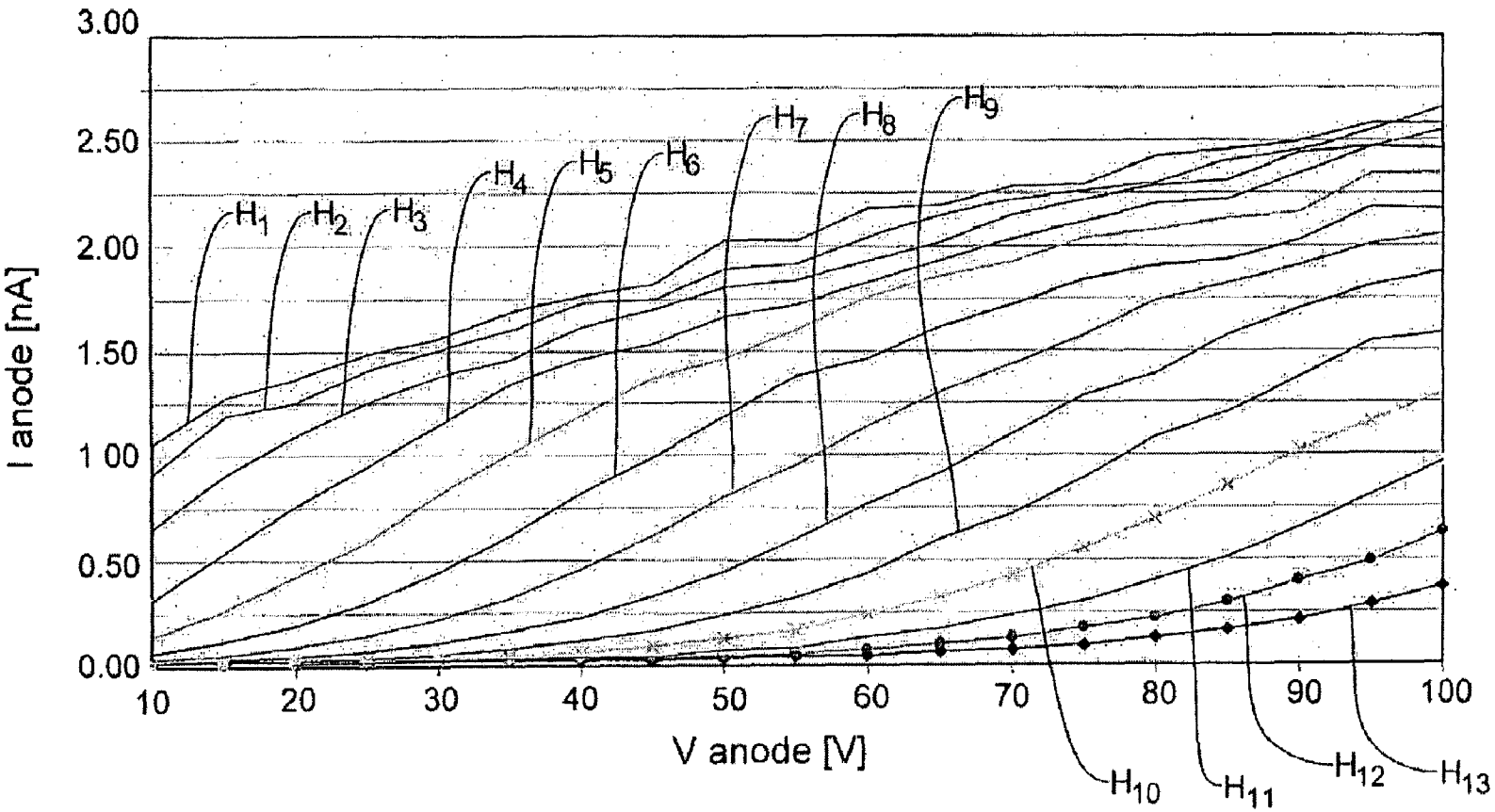
Figure 7C:
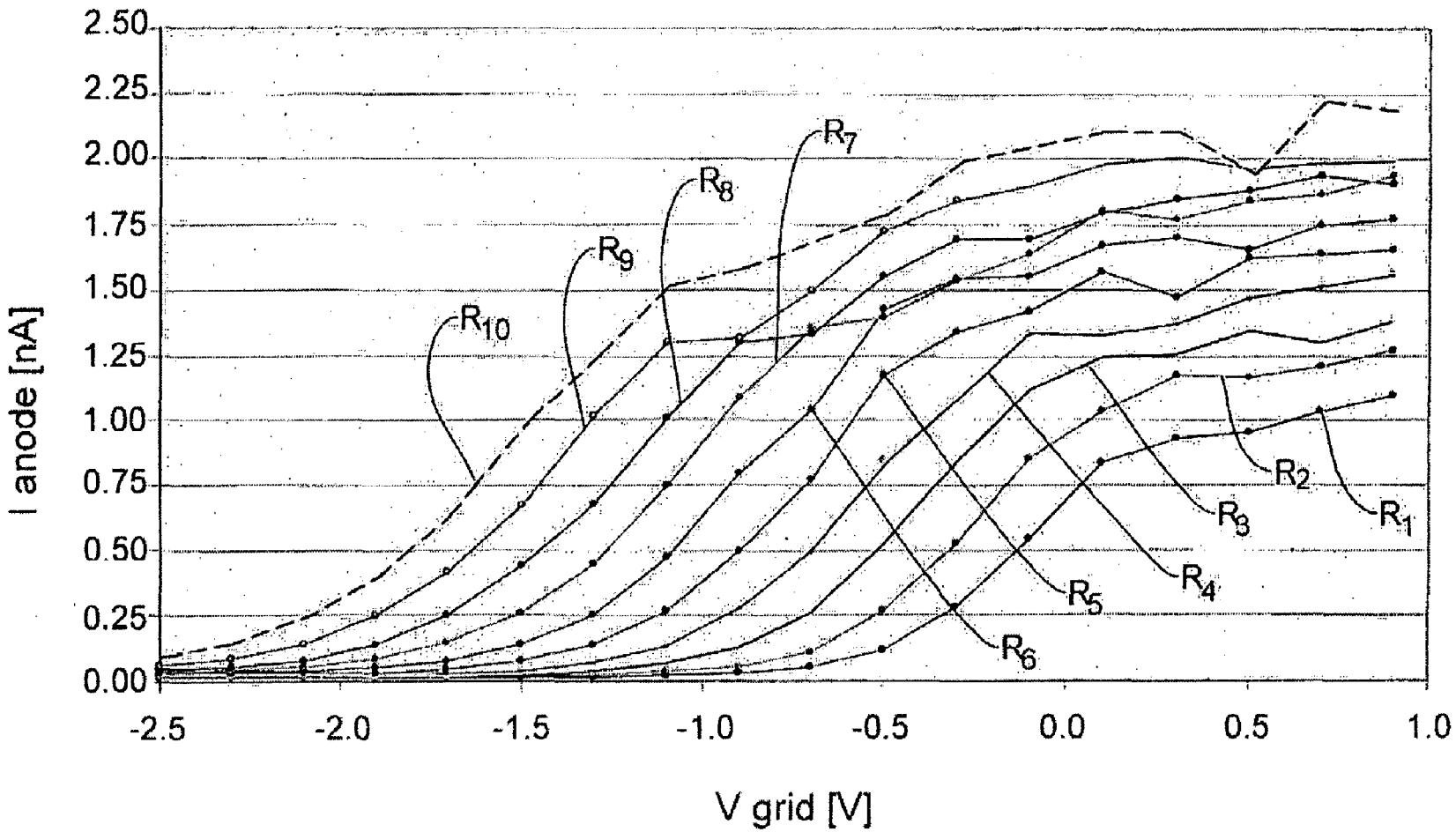

Reference is now made to FIGS. 7A-7C, showing another experimental results illustrating the features of the present invention.

FIG. 7A shows an electron photoemission switching device 400 of the present invention designed as a simple planar triode structure. The device was vacuum sealed, and a light source assembly (illuminator) 20 was used to illuminate a semi-transparent Photocathode 12A from outside via an optically transparent substrate 14. Electrodes' arrangement 12 further includes an Anode electrode 12B, and a Gate electrode 12C in the form of a grid between the Cathode and Anode.

The substrate 14 is a fused silica glass of a 500 μm thickness. The Photocathode 12A is made as a photo-emissive coating on the surface of the substrate 14. The Photocathode is W—Ti (90%-10%) of a 15 nm thickness deposited onto the substrate by E-Beam Evaporation. (0.1 nm/sec). The Gate-grid 12C is formed by an array of spaced-apart parallel wires of metal with a 50 μm diameter and a 150 μm spacing between wires (center to center). The Anode electrode 12B is made from copper and has a thickness of 10 mm. The light source 20 is a UV source (super pressure mercury lamp) with the light output power of 100 mW in the effective range (240-280 nm). Light was guided onto the back side of the Photocathode by a special Liquid Lightguide 21. The electrodes arrangement 12 was sealed in a ceramic envelope, and prior to measurements, air was pumped out of the envelope (using a simple vacuum pump) to obtain a $10^{-5}$ Torr pressure. During the measurements, the Photocathode 12A was kept grounded.

FIGS. 7B and 7C show the measurement results, wherein FIG. 7B shows the volt-ampere characteristics measured on the Anode (12B in FIG. 7A) for different voltages, on the Gate-grid 12C, and FIG. 7C shows the Anode current as a function of the Gate voltage for different voltages on the Anode 12B. Graphs $H_1$-$H_{13}$ in FIG. 7B correspond to, respectively, the following values of Gate voltages 0.4V, 0.2V, 0.0V, −0.2V, −0.4V, −0.6V, −0.8V, 1.0V, −1.2V, 1.4V, −1.6V, −1.8V, and −2.0V Graphs $R_1$-$R_{10}$ in FIG. 7C correspond to, respectively, the following voltages on the Anode: 10V, 20V, 30V, 40V, 50V, 60V, 70V, 80V 90V and 100V.

The inventors have shown that by replacing the W—Ti Photocathode with such more efficient photoemissive material as for example Cs—Sb, an electric current of 6 orders of magnitude higher can be obtained, and at the same time within a visible spectral range, which enables using simple LEDs instead of UV light source.

Figure 8A:
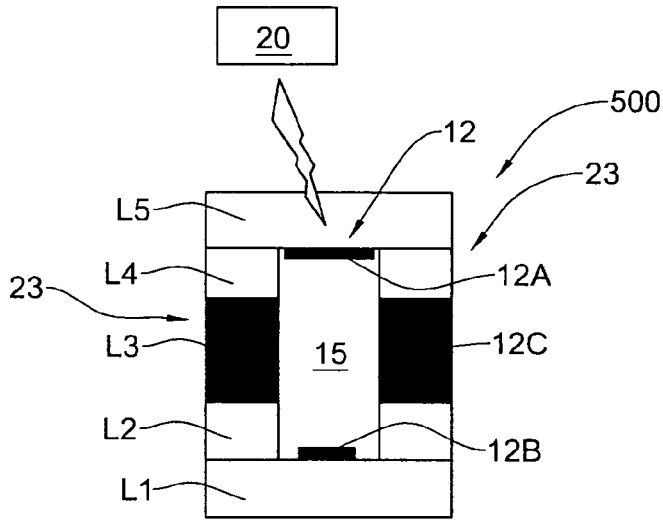
Figure 8B:
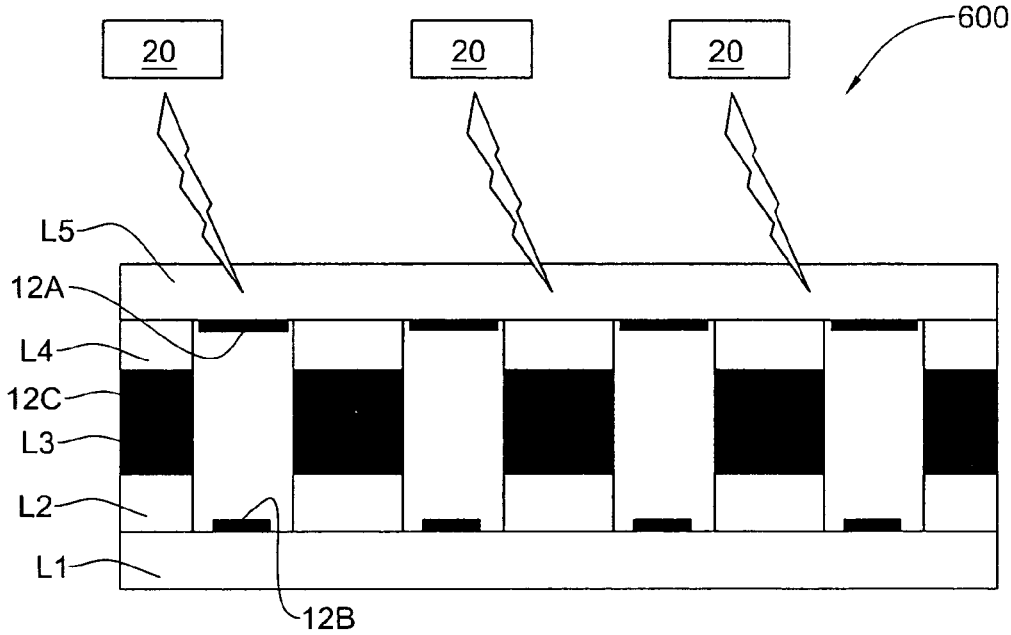
Figure 8C:
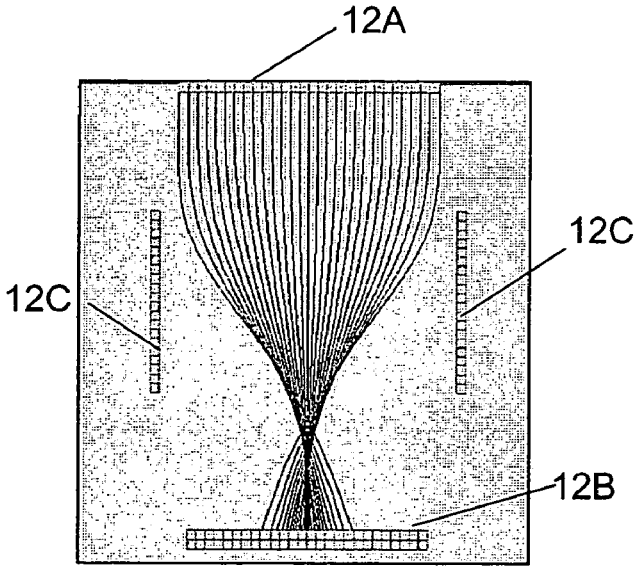
Figure 8D:
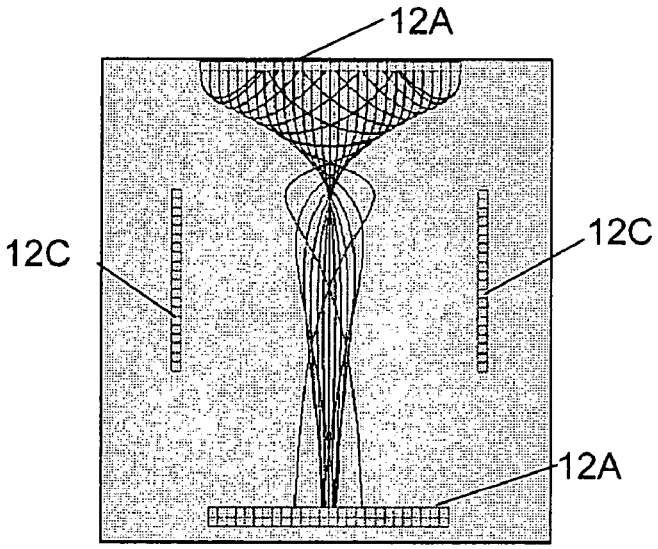
Figure 8E:
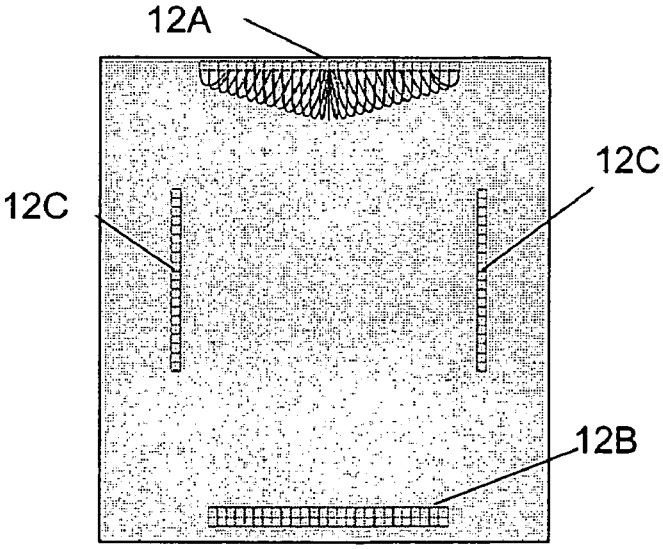

Reference is now made to FIGS. 8A-8E exemplifying yet another implementation of an electron photoemission switching device of the present invention in a micron scale. Such a device may be fabricated by various known semiconductor technologies. FIG. 8A shows a device 500 presenting a basic unit of a multiple-units device 600 shown in FIG. 8B. FIGS. 8C-8E show electrostatic simulation of the operation of the device of FIG. 8A.

As shown in FIG. 8A, the device 500 includes an electrodes' arrangement 12 and an illuminator 20. The electrodes' arrangement 12 is a multi-layer (stack) structure 23 defining a Cathode electrode 12A and Anode electrodes 12B spaced-apart by a gap 15 between them defined by a spacer layer structure, which in the present example of a transistor configuration includes a Gate electrode 12C.

The structure 23 includes a base substrate layer $L_1$ (insulator material, e.g. glass) carrying the Anode layer 12B made from a highly electrically conductive material (e.g. Aluminum or Gold); a dielectric material layer $L_2$ (e.g. $SiO_2$, for example of about 1.5 μm thickness); a Gate electrode layer $L_3$ made from a highly electrically conductive material (e.g. Aluminum or Gold) for example of about 2 μm thickness; a further dielectric material layer $L_4$ (e.g. $SiO_2$ of about 1.5 μm thickness); and an upper substrate layer $L_5$ made of a material transparent to light in the spectral range of exciting radiation (e.g. Quartz) and carrying the Cathode layer 12A made from a semitransparent photoemissive material (e.g., of a few tens of nanometers in thickness). The spacer layer structure (dielectric and Gate layers $L_2$-$L_4$) is patterned to define the gap 15 between the Cathode and Anode electrodes 12A and 12B and to define the Gate-grid electrode 12C. In the present example, the gap 15 is a vacuum trench of about 3 μm width and about 5 μm height.

It should be noted that the Anode carrying substrate $L_1$ may be transparent and the illumination may be applied to the reflective Cathode from the Anode side of the device via the gap 15. In the case the Anode occupies the entire surface of the substrate $L_1$ below the Cathode, the Anode is also made optically transparent. Otherwise, illumination is directed to the Cathode via regions of the substrate $L_1$ outside the Anode carrying region thereof.

It should be understood that the device 500 (as well as device 600 of FIG. 8B) may be designed using various other configurations, for example, Anode and Cathode could be switched in location, either one of Anode and Cathode, or both of them may cover the entire surface of the corresponding substrate (although this will result in much higher inter-electrode capacitance, and therefore, inferior performance at high frequencies). The upper substrate layer $L_5$ and electrode layer thereon (Cathode layer 12A in the present example) can be placed on the dielectric layer $L_4$ by wafer bonding, flip-chip or any other technique. The thickness of layers and the width of the gap 15 can be changed significantly with respect to each other without harming the basic functionality of the device. All the dimensions can be scaled up or down a few orders of magnitudes and still keep the same principals of the device operation.

In order to obtain higher output currents from the electron emission device, several such cavities 500 may be connected together, in parallel, for example as shown in FIG. 8B illustrating the device 600 formed by four sub-units 500.

It should be noted that the trench 15 can be made relatively wide (dimension along the horizontal plane), e.g., a few millimeters. The entire device 600, containing a few thousands of such wide trenches, located side-by-side, can occupy an area of about 1 $cm^2$, thus yielding relatively high current values. All the Anode electrodes 12B, Cathode electrodes 12A and Gate electrodes 12C are connected in parallel, in order to obtain an accumulated current yield, (inter-connections are not shown in the figure). Alternatively, the above device units may be accessed individually, e.g., for creating a phased array. It should also be noted that the illuminator 20 may include a single light source assembly and light is appropriately guided to the units 500. (e.g., via fibers).

FIGS. 8C-8E show the electrostatic simulations of the operation of the device 500 or sub-unit of the device 600. To facilitate illustration, only the electrodes are shown, namely, Photocathode 12A, Anode 12B and Gate 12C. In these simulations, the Photocathode 12A is illuminated and kept at 0V, and Anode 12B is kept at 5V FIG. 8C shows the electron trajectories when the Gate voltage is 0V (full Anode current). FIG. 8D shows the situation when the Gate voltage is −0.7V, and FIG. 8E corresponds to the Gate voltage of −1V (no Anode current). Electrons are ejected with energy $E_k$ of 0.15eV.

Figure 9A:
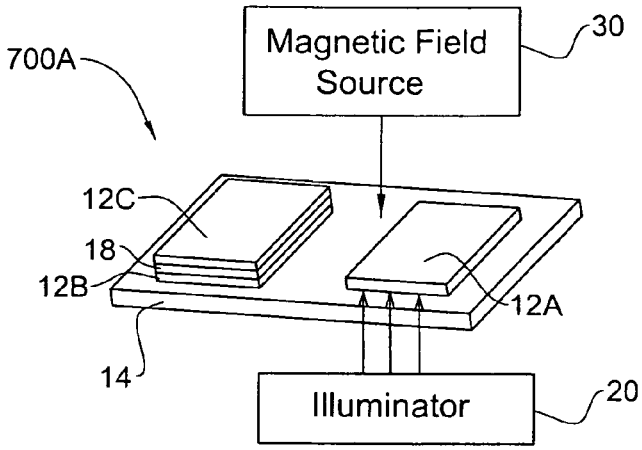
FIGS. 9A to 9C illustrate yet another examples of an electron photoemission switching device of the present invention configured and operable utilizing a spintronic effect in a transistor structure.
Figure 9B:
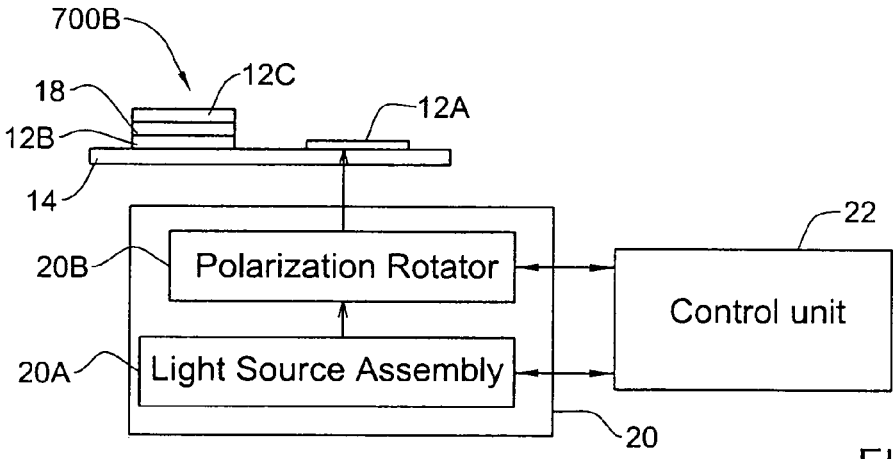
Figure 9C:
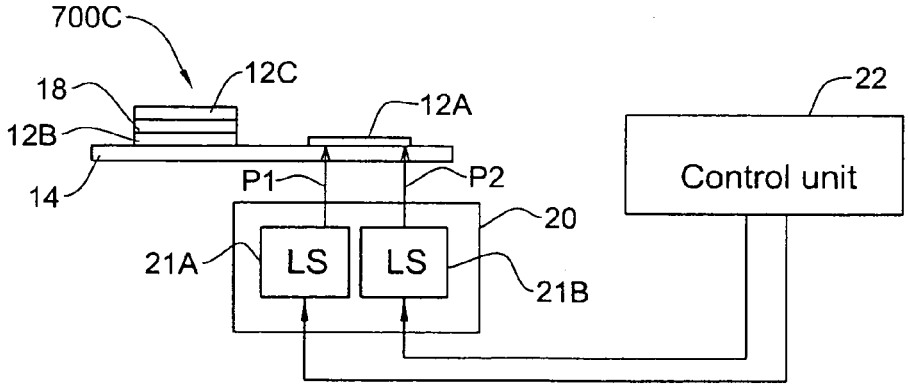

Reference is made to FIGS. 9A-9C illustrating yet another implementation of a device of the present invention configured and operable utilizing a spintronic effect in a transistor structure.

FIG. 9A shows an electron photoemission switching device 700A of the present invention including a transistor structure formed by an electrodes arrangement 12 (Cathode 12A, Anode 12B and Gate 12C); an illuminator 20; and a magnetic field source 30. The Cathode and Anode electrodes are made from ferromagnetic materials different in that their magnetic moment directions are opposite, thus implementing a spin valve. Operation at the SPIN UP state of both the Cathode and Anode electrodes provides for improved signal-to-noise. Operating the magnetic field source 30 to apply an external magnetic field to the electrodes' arrangement, results in shifting the Cathode or Anode electrode between SPIN UP and SPIN DOWN states and thus results in shifting the transistor between its ON and OFF states.

FIGS. 9B and 9C exemplify electron photoemission switching devices 700B and 700C, in which a Cathode is made from non-ferromagnetic metal or semiconductor and Anode is made from ferromagnetic material. In this case, spin polarized electrons can be emitted from the Cathode when appropriately configuring and operating the illuminator 20 to selectively apply to the Cathode light of different polarizations. As shown in the example of FIG. 9B, the illuminator 20 includes a single light source assembly 20A equipped with a polarization rotator 20B (e.g., $\lambda/4$ plate). In the example of FIG. 9C, the illuminator 20 includes two light source assemblies (LS) 21A and 21B producing light of different polarizations $P_1$ and $P_2$, respectively. In these examples, shifting the transistor between its ON and OFF states is achieved by varying the polarization of illuminating light (i;e., selectively operating the polarization rotator 20B to be in the optical path of illuminating light in the example of FIG. 9B or selectively operating one of the light sources 21A and 21B in the example of FIG. 9C), or by shifting the Anode electrode between SPIN UP and SPIN DOWN high-transmission states.

It should be noted that the device configuration of FIG. 9C may be used for controlling the electric current between the Cathode and Anode. In this case, the light sources 21A and 21B are operated at different ratio. Moreover, in all the above-described devices, more than one Cathode, Anode, Gate, and light source can be used.

As indicated above, the gap between the Cathode and Anode electrodes may be a gas-medium gap (e.g., air, inert gas) and not a vacuum gap. The length of the gas-medium gap substantially does not exceed a mean free path of electrons in the gas environment. For example, the gap length is in a range from a few tens of nanometers (e.g., 50 nm) to a few hundreds of nanometers (e.g., 800 nm).

Considering the device configuration with the gas-medium gap between the Cathode and Anode and no photoelectric effect (e.g., no illuminator 20 in FIGS. 1 or 2), the switching can be achieved by affecting a potential difference between the Cathode and Anode electrodes and thus affecting an electric current between them; or by maintaining the Cathode and Anode at a certain potential difference and affecting a voltage supply to the Gate. Turning back to FIG. 9A, it should be understood that the same principles are applicable to such a gas-medium based device with no photoelectric effect to implement a spin valve.

Those skilled in the art will readily appreciate that various modifications and changes can be applied to the embodiments of the invention as hereinbefore described without departing from its scope defined in and by the appended claims.

The invention claimed is:

1. An electronic switching device comprising:

an electrodes' arrangement including at least one Cathode electrode and at least one Anode electrode, the Cathode and Anode electrodes being arranged in a spaced-apart relationship, the device being configured to expose said at least one Cathode electrode to exciting illumination to thereby cause electrons' emission from said Cathode electrode; and a control unit connected to the electrodes' arrangement and operable to affect a change in electric current between the Cathode electrode and the Anode electrode by at least one of the following: controllably varying illumination intensity of the Cathode electrode while maintaining an electric field between the Cathode electrode and the Anode electrode, and controllably varying an electric field between the Cathode electrode and the Anode electrode while maintaining illumination of the Cathode electrode to thereby enable the device to operate as a photoemission switching device.

2. The device of claim 1, wherein the Cathode and Anode electrodes are spaced by a gas-medium gap.

3. The device of claim 1, wherein the Cathode and Anode electrodes are spaced by a vacuum gap.

4. The device of claim 2, wherein the gas pressure is selected to be sufficiently low to ensure that a mean free path of electrons accelerating from the Cathode to the Anode is larger than a length of the gap between the Cathode and the Anode electrodes.

5. The device of claim 1, wherein said electrodes' arrangement comprises an array of Anode electrodes arranged in a spaced-apart relationship.

6. The device of claim 1, wherein said electrodes' arrangement comprises an array of Cathode electrodes arranged in a spaced-apart relationship.

7. The device of claim 6, wherein said electrodes' arrangement comprises an array of Anode electrodes arranged in a spaced-apart relationship.

8. The device of claim 1, wherein said control unit is operable to carry out said controllably varying of the electric field and thus control an electric current between the Cathode and Anode electrodes by varying a potential difference between the Cathode and the Anode electrodes, while maintaining a certain illumination of the Cathode electrode, thereby affecting the Anode current.

9. The device of claim 1, operable to control an electric current between the Cathode and Anode electrodes maintained at a certain potential difference between them, by modifying the illumination of the Cathode, thereby affecting the Anode current.

10. The device of claim 1, operable to control an electric current between the Cathode and Anode electrodes by varying a potential difference between them and modifying the illumination of the Cathode, thereby affecting the Anode current.

11. The device of claim 1, wherein said electrodes' arrangement includes at least one additional electrode electrically insulated from the Cathode electrode and the Anode electrode.

12. The device of claim 11, wherein the additional electrode is configured as a grid located between the Cathode and Anode electrodes.

13. The device of claim 11, wherein the additional electrode is accommodated in a plane spaced-apart from a plane where the Cathode and Anode electrodes are located.

14. The device of claim 11, wherein the electrodes are located in different planes.

15. The device of claim 11, wherein the control unit operates a voltage supply to said at least one additional electrode to thereby carry out said controllably varying of the electric field between the Cathode electrode and the Anode electrode thus controlling an electric current between the Cathode and Anode electrodes.

16. The device of claim 11, wherein the control unit controls said controllably varying of the electric field between the Cathode electrode and the Anode electrode and thus controls an electric current between the Cathode and Anode electrodes by varying a voltage supply to said at least one additional electrode, while maintaining illumination of the Cathode and maintaining a certain potential difference between the Cathode and Anode electrodes, thereby affecting the Anode current.

17. The device of claim 11, operable to control an electric current between the Cathode and Anode electrodes by varying a voltage supply to said at least one additional electrode and modifying the illumination of the Cathode thereby affecting the Anode current.

18. The device of claim 1, wherein said electrodes' arrangement comprises electrodes made from metal materials.

19. The device of claim 1, wherein said electrodes' arrangement comprises electrodes made from semiconductor materials.

20. The device of claim 1, wherein one of the Cathode and Anode electrodes is made from metal, and the other from semiconductor material.

21. The device of claim 1, wherein one of the Cathode and Anode electrodes is made from metal, and the other from a mixture of metal and semiconductor.

22. The device of claim 1, wherein the Cathode electrode is coated or doped with an organic or inorganic material.

23. The device of claim 1, wherein the Cathode electrode is formed with a portion thereof having a sharp edge.

24. The device of claim 1, comprising an illuminating assembly operable with a wavelength range including the exciting illumination to cause electrons emission from the Cathode.

25. The device of claim 24, wherein the illuminating assembly includes at least one of the following: a low pressure discharge lamp, a high pressure discharge lamp, a continuous wave laser device, a pulsed laser device, at least one non-linear crystal, and at least one light emitting diode.

26. The device of claim 25, wherein said illuminating assembly includes a Hg lamp.

27. The device of claim 25, wherein said illuminating assembly includes a Xe lamp.

28. The device of claim 1, wherein the Cathode and Anode electrodes are made from ferromagnetic materials different in that their magnetic moment directions are opposite, the device being thereby operable as a spin valve, shifting one of the Cathode and Anode electrodes between its SPIN UP and SPIN DOWN states resulting in shifting the device between its inoperative and operative positions.

29. The device of claim 28, comprising a magnetic field source operable to apply an external magnetic field to the electrodes' arrangement, the application of the external magnetic field shifting said one of the Cathode and Anode electrodes between its SPIN UP and SPIN DOWN states.

30. The device of claim 1, wherein the Cathode electrode is made from non-ferromagnetic metal or semiconductor and the Anode electrode is made from a ferromagnetic material, the device being shiftable between its operative and inoperative positions by varying polarization of the illumination.

31. The device of claim 1, comprising an illuminating assembly operable with a wavelength range including said exciting illumination, the illuminating assembly being configured to produce light of various polarizations.

32. The device of claim 1, wherein the Cathode electrode is made from non-ferromagnetic metal or semiconductor and the Anode electrode is made from a ferromagnetic material, the device being shiftable between its different modes of operation by shifting the Anode electrode between SPIN UP and SPIN DOWN high transmission states.

33. The device of claim 1, wherein the Cathode electrode is located on a substrate transparent for a wavelength range including the exciting illumination causing the electrons emission from the Cathode, thereby allowing illumination of the Cathode electrode through said transparent substrate.

34. The device of claim 1, wherein the Cathode and Anode electrodes are carried by first and second spaced-apart substrates, respectively.

35. The device of claim 34, wherein the second substrate is transparent for a wavelength range including the exciting illumination causing the electrons emission from the Cathode, thereby allowing illumination of the Cathode electrode through regions of said second substrate outside the Anode electrode.

36. The device of claim 34, wherein the second substrate and the Anode electrode are transparent for a wavelength range including the exciting illumination causing the electrons emission from the Cathode, thereby allowing illumination of the Cathode electrode through the Anode electrode.

37. The device of claim 1, wherein the electrodes' arrangement is an integrated structure comprising first and second substrate layers for carrying the Cathode and Anode electrodes, respectively; and a spacer layer structure between the first and second substrate layers, the spacer layer structure being patterned to define a gap between the Cathode and Anode electrodes.

38. The device of claim 37, wherein the spacer layer structure comprises at least one dielectric material layer.

39. The device of claim 37, wherein the spacer layer structure comprises first and second dielectric layers and an electrically conductive layer between said first and second dielectric layers, the patterned electrically conductive layer defining an additional electrode.

40. The device of claim 37, wherein the first substrate is made of a material transparent with respect to a wavelength range including the exciting illumination causing the electrons emission from the Cathode, thereby allowing the illumination of the Cathode through the first substrate.

41. The device of claim 37, wherein the second substrate is transparent for a wavelength range including the exciting illumination causing the electrons emission from the Cathode, thereby allowing illumination of the Cathode electrode through regions of said second substrate outside the Anode electrode.

42. The device of claim 37, wherein the second substrate and the Anode electrode are transparent for a wavelength range including the exciting illumination causing the electrons emission from the Cathode, thereby allowing illumination of the Cathode electrode through the Anode electrode.

43. The device of claim 1, wherein the electrodes' arrangement is an integrated structure comprising:

a first substrate layer for carrying an array of the spaced-apart Cathode electrodes;

a second substrate layer for carrying an array of the spaced-apart Anode electrodes; and a spacer layer structure between the first and second substrate layers, the spacer layer structure being patterned to define an array of spaced-apart gaps between the first and second arrays of electrodes.

44. The device of claim 43, wherein the spacer layer structure comprises at least one dielectric material layer.

45. The device of claim 43, wherein the spacer layer structure comprises first and second dielectric layers and an electrically conductive layer between said first and second dielectric layers, the patterned electrically conductive layer defining an array of additional electrodes.

46. The device of claim 43, wherein the first substrate is made of a material transparent with respect to a wavelength range of the exciting illumination causing the electrons emission from the Cathode, thereby allowing the illumination of the Cathode electrodes through the first substrate.

47. The device of claim 43, wherein the second substrate is transparent for a wavelength range including the exciting illumination causing the electrons emission from the Cathode, thereby allowing illumination of the Cathode electrodes through regions of said second substrate outside the Anode electrodes.

48. The device of claim 43, wherein the second substrate and the Anode electrode are transparent for a wavelength range including the exciting illumination causing the electrons emission from the Cathode, thereby allowing illumination of the Cathode electrodes through the Anode electrodes.

49. An electronic switching device comprising:

an electrodes' arrangement including at least one Cathode electrode and at least one Anode electrode arranged in a spaced-apart relationship, the device being configured to expose said at least one Cathode electrode to exciting illumination to cause electron emission therefrom; and a control unit connectable to the electrodes' arrangement and to an illuminator and operable for effecting a switching function enabling the device operation as a photoemission switching device by affecting a change in electric current between the Cathode and Anode electrodes by carrying out at least one of the following: controllably varying the illumination of the Cathode electrode while maintaining an electric field between the Cathode electrode and the Anode electrode, and controllably varying an electric field between the Cathode and Anode electrodes while maintaining illumination of the Cathode electrode.

50. An electronic switching device comprising:

an electrodes' arrangement including at least one Cathode electrode, at least one Anode electrode, and at least one additional electrode arranged in a spaced-apart relationship, the device being configured to expose said at least one Cathode electrode to exciting illumination to thereby cause electrons' emission from said at least one illuminated Cathode electrode towards said at least one Anode electrode; and a control unit connectable to the electrodes' arrangement and to an illuminator and operable for effecting a switching function enabling the device being operable as a photoemission switching device by affecting a change in electric current between the Cathode and Anode electrodes, by carrying out at least one of the following: controllably varying the illumination of the Cathode electrode while maintaining an electric field between the Cathode electrode and the Anode electrode, and controllably varying an electric field between the Cathode and Anode electrodes while maintaining illumination of the Cathode electrode.

51. An electronic switching device comprising:

an electrodes' arrangement including at least one Cathode electrode, at least one Anode electrode, and at least one additional electrode arranged in a spaced-apart relationship, the device being configured to expose said at least one Cathode electrode to exciting illumination to thereby cause electrons' emission from said at least one illuminated Cathode electrode towards said at least one Anode electrode; and a control unit connectable to the electrodes' arrangement and operable to affect a change in electric current between the Cathode electrode and the Anode electrode by at least one of the following: controllably varying illumination intensity of the Cathode electrode while maintaining an electric field between the Cathode electrode and the Anode electrode, and controllably varying an electric field between the Cathode electrode and the Anode electrode while maintaining illumination of the Cathode electrode to thereby effect a switching function and enable the device operation as a photoemission switching device.

52. An integrated device comprising at least one structure operable as an electrons' switching unit, said at least one structure comprising:

at least one Cathode electrode carried by a first substrate layer and at least one Anode electrode carried by a second substrate layer, the first and second substrate layers being spaced from each other by a spacer layer structure including at least one dielectric layer, the spacer layer structure being patterned to define a gap between the Cathode and Anode electrodes, at least one of the first and second substrates being made of a material transparent with respect to certain exciting radiation to thereby enable illumination of the at least one Cathode electrode to cause electrons emission therefrom; and a control unit connectable to the Cathode and Anode electrodes and operable to affect a change in electric current between the Cathode electrode and the Anode electrode by at least one of the following: controllably varying illumination intensity of the Cathode electrode while maintaining an electric field between the Cathode electrode and the Anode electrode, and controllably varying an electric field between the Cathode electrode and the Anode electrode while maintaining illumination of the Cathode electrode to thereby effect a switching function and enable the device being operable as a photoemission switching device.

53. An electronic switching device comprising:

an electrode arrangement comprising at least one Cathode electrode and at least one Anode electrode, the Cathode electrode and the Anode electrode being arranged in a spaced-apart relationship, the device being configured to expose the at least one Cathode electrode to exciting illumination to thereby cause electron emission from the Cathode electrode, and a control unit associated with the electrode arrangement and operable to affect a change in electric current between the Cathode electrode and the Anode electrode by controllably varying an electric field between the Cathode electrode and the Anode electrode while maintaining illumination of the Cathode electrode to thereby enable the device to operate as a photoemission switching device.

* * * * *